US005133304A

United States Patent [19]

Koshimoto et al.

[11] Patent Number: 5,133,304

[45] Date of Patent: Jul. 28, 1992

[54] COOLING WATER PASSAGE FOR V-TYPE INTERNAL COMBUSTION ENGINE

[75] Inventors: Naohide Koshimoto; Keiji Araki, both of Hiroshima, Japan

[73] Assignee: Mazda Motor Corporation, Hiroshima, Japan

[21] Appl. No.: 710,714

[22] Filed: Jun. 7, 1991

[30] Foreign Application Priority Data

Jun. 8, 1990 [JP] Japan ..... 2-60838[U]

[51] Int. Cl.[5] ..... F02F 1/36

[52] U.S. Cl. ..... 123/41.82 R; 123/55 VS; 123/41.74

[58] Field of Search ..... 123/41.01, 41.74, 41.82 R, 123/55 VS, 55 VE, 55 VF, 195 R, 195 C

[56] References Cited

U.S. PATENT DOCUMENTS 4,590,894 5/1986 Ishida et al. ..... 123/41.74
4,745,885 5/1988 Koinuma ..... 123/41.05
4,953,525 9/1990 Sakurai et al. ..... 123/55 VS
5,035,207 7/1991 Sakurai et al. ..... 123/55 VS

FOREIGN PATENT DOCUMENTS 62-91615 4/1987 Japan .

*Primary Examiner*—Noah P. Kamen
*Attorney, Agent, or Firm*—Fleit, Jacobson, Cohn, Price, Holman & Stern

[57] ABSTRACT

A particular cooling water passage structure is installed in a V-type engine having two cylinder banks offset in a lengthwise direction of a crankshaft. Each bank is provided with inlet ports, provided to admit a cooling water flow. Each inlet port communicates with a lengthwise front end portion of the water jacket. The inlet port of one of the cylinder banks, which is offset forward relative to the other, is further in communication with a side portion, adjacent to the front end portion, of the water jacket. The inlet ports have apertures which open at the same location in the lengthwise direction. Piping, connected to the inlet ports, is provided in a space formed between the offset cylinder banks.

5 Claims, 4 Drawing Sheets

COOLING WATER PASSAGE FOR V-TYPE INTERNAL COMBUSTION ENGINE

The present invention relates to the structure of a cooling water passage for a V-type internal combustion engine and, more particularly, to a cooling water passage structure which includes a cooling water inlet port in communication with a water jacket of a cylinder head.

BACKGROUND OF THE INVENTION

1. Field of the Invention

A cooling system of a V-type multi-cylinder engine, with two cylinder banks arranged in a V formation, typically has a water pump and a confluence pipe arranged on opposite ends of a cylinder head in a lengthwise direction of the engine, i.e., a direction in which a crankshaft extends. The confluence pipe is conventionally provided with a valve casing, having a built-in thermostatic valve. The thermostatic valve and the water pump are in communication with each other, via a passage located between the cylinder banks, so as to supply cooling water, from a radiator, to the water pump via the thermostatic valve, and forward the cooling water, by the water pump, to the water jackets of the cylinder banks. The cooling water discharged from the water jackets is returned to the radiator via the confluence pipe. Such a cooling system is known from, for instance, Japanese Unexamined Patent Publication No 62-91615.

2. Description of Related Art

Because, in the cooling system described in the Japanese publication mentioned above, the water pump and confluence pipe are located on opposite sides of the cylinder head, it is possible to make the piping of the cooling water passages compact. For supplying cooling water to or discharging cooling water from the water jackets, cooling water ports are, in the cooling system disclosed by the Japanese publication mentioned above, provided to admit and expel cooling water to and from the cylinder banks, respectively. Such ports may be provided, for example, in the cylinder heads. For smooth flow of cooling water in the water jackets, so that efficient cooling of a combustion chamber of each cylinder is performed, it is typical to dispose the cooling water ports at the lengthwise opposite ends of each cylinder bank.

However, in the V-type multi-cylinder engine of the Japanese publication referred to above, it is necessary for each cylinder of the cylinder banks to be coupled or connected to the crankshaft. Therefore, the cylinder banks are offset in the lengthwise direction of the crankshaft relative to each other, so as to offset rows of the cylinders of the cylinder banks, and the overall length of the engine becomes greater than the length of each cylinder bank. Accordingly, disposing the cooling water ports so that they project from the ends of the cylinder heads in the lengthwise direction of the engine, and connecting pipes for cooling water passages to the cooling water ports, causes a further increase in overall length of the engine. This makes it difficult to construct the engine so that it is compact.

SUMMARY OF THE INVENTION

The present invention has a primary object of providing a cooling water passage structure which makes it possible for a V-type internal combustion engine to be short in overall length and compact in size.

Another object of the present invention is to provide a cooling water passage structure which provides effective cooling of cylinders.

According to the present invention, such a cooling water passage structure is incorporated in a V-type multi-cylinder internal combustion engine, which has first and second cylinder banks set at an angle to each other to define a V-shaped space therebetween. Each cylinder bank is constituted by a cylinder block, including a row of cylinders, and a cylinder head, which is formed with a row of intake and exhaust ports surrounded by a water jacket and which is mounted on the cylinder block. The row of intake and exhaust ports of the first cylinder bank is offset forward in a lengthwise direction of a crankshaft relative to the row of intake and exhaust ports of the second cylinder bank.

The engine is provided with a first port, projecting from one side of the cylinder head of the first cylinder bank so as to communicate with a front end portion of the water jacket, adjacent to a front end of the row of intake and exhaust ports, of the cylinder head of the first cylinder bank. The engine is further provided with a second port, projecting from one side of the cylinder head of the second cylinder bank so as to communicate with an end portion of the water jacket, adjacent to a front end of the row of intake and exhaust ports, of the cylinder head of the second cylinder bank. The first and second ports have openings or apertures which open in the same direction at the same location in the lengthwise direction.

In the cooling water passage structure of the present invention, the ports are disposed in the side portion of each cylinder head so as not to project from the front end portions of the cylinder heads in the lengthwise direction of crankshaft. The cooling water piping leading to inlets of these ports is arranged to utilize what is known as a "dead space", formed between the end portions of the cylinder banks due to the offset of the cylinder banks in the lengthwise direction of the crankshaft.

Furthermore, because the inlets of the ports open at the same position in the lengthwise direction of the crankshaft, piping, forming the cooling water passages and connected to the port means, is not complicated and is satisfactorily compact.

In addition, the port in the first cylinder bank, which is offset forward in the lengthwise direction of the crankshaft relative to the second cylinder bank, is in communication with the front end portion of the water jacket and the side portion, adjacent to the front end portion, of the water jacket. Consequently, the flow rate of cooling water passing through the water jackets and the port means can be kept high, and the flow of cooling water in the water jacket is kept smooth.

BRIEF DESCRIPTION OF THE DRAWINGS

The above and other objects and features of the present invention will be understood from the following detailed description of a preferred embodiment thereof when considered in conjunction with the accompanying drawings, in which.

DETAILED DESCRIPTION OF THE PREFERRED EMBODIMENT

Figure 1:
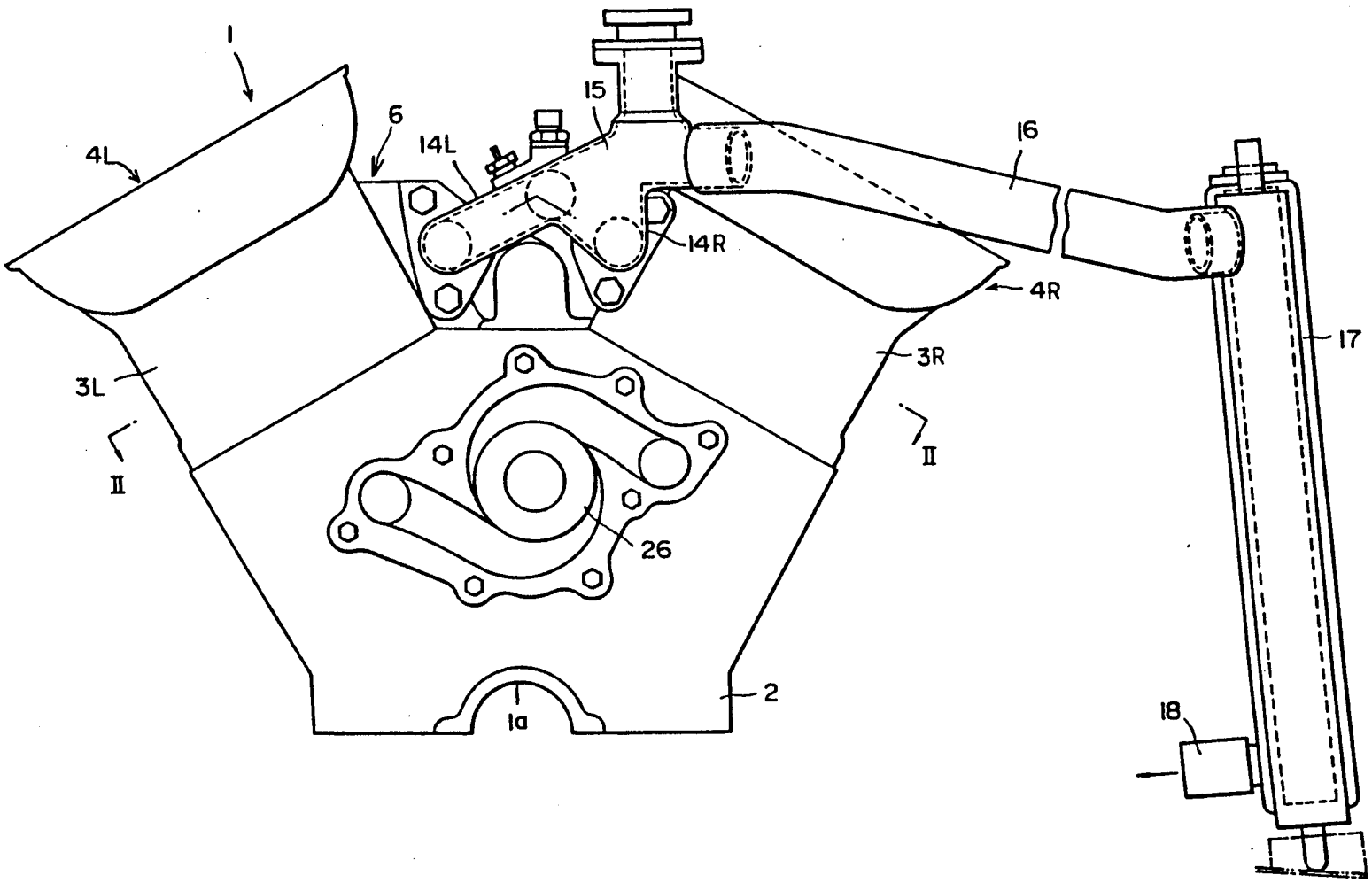
FIG. 1 is an elevational view of a V-type engine having a structure for circulating cooling water in accordance with a preferred embodiment of the present invention.

Referring to the drawings in detail, an engine body 1 of a V-6 double overhead camshaft (DOHC) engine having a cooling water passage structure in accordance with a preferred embodiment of the present invention is shown, and includes two, i.e., first and second, or left and right, cylinder banks 4L and 4R arranged in a V-formation with a predetermined relative angle of, for example, 60 degrees therebetween. The engine 1 has a cylinder block 2 formed with cylinders 5, in which pistons (not shown) can slide. A left cylinder head 3L is mounted on the cylinder block 2 and provides for the left cylinder bank 4L. Similarly, a right cylinder head 3R is mounted on the cylinder block 2 and provides for the right cylinder bank 4R. Cylinder block 2 thus is common to both the left and right cylinder banks 4L and 4R.

The cylinders 5 in the left cylinder bank 4L and the cylinders 5 in the right cylinder bank 4R are arranged in rows parallel to a crankshaft (not shown), which is supported by bearings 1*a* for rotation. The row of cylinders 5 in the left cylinder bank 4L is offset forward, with respect to the vehicle in which it is mounted (downward in FIG. 2), relative to the row of the cylinders 5 in the right cylinder bank 4R. Because of this offset arrangement, as is clear from FIG. 2, the left cylinder head 3L projects forward with respect to the vehicle relative to the right cylinder head 3R, so as to form what is called a "dead space" 6 beside the projected part of the left cylinder head 3L at the front end of the right cylinder head 3R.

Figure 2:
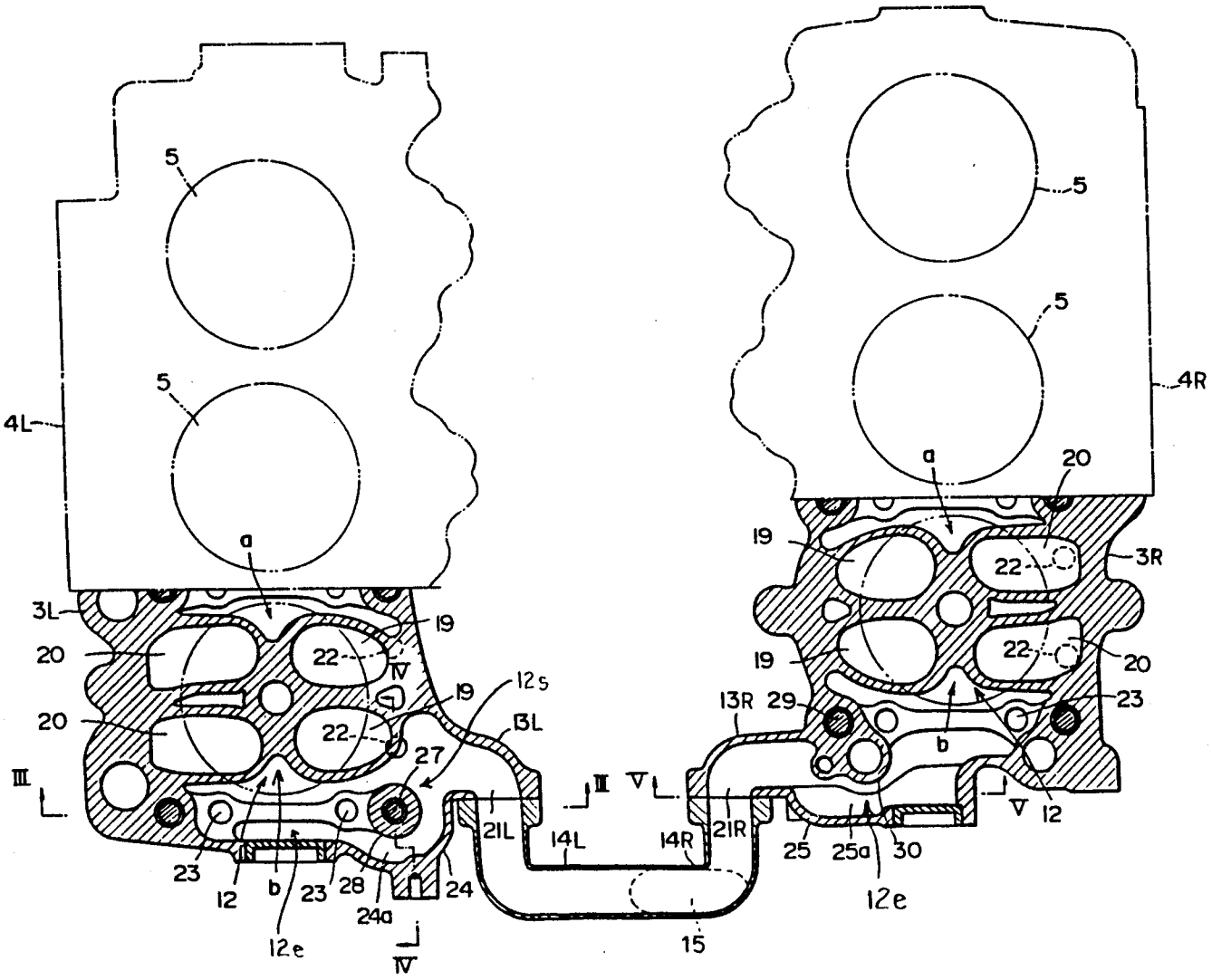
FIG. 2 is an enlarged cross-sectional view as seen along line II—II of FIG. 1.

In each cylinder bank 4L or 4R, the cylinder head 3L or 3R is further provided with a pair of intake and exhaust camshafts 7 and 8, which drive intake and exhaust valves (not shown) to open and shut intake and exhaust ports 19 and 20, leading to each cylinder 5, respectively, at a predetermined timing. As FIG. 2 shows, each of the cylinder heads 3L and 3R is formed with a row of these intake and exhaust ports.

Figure 4:
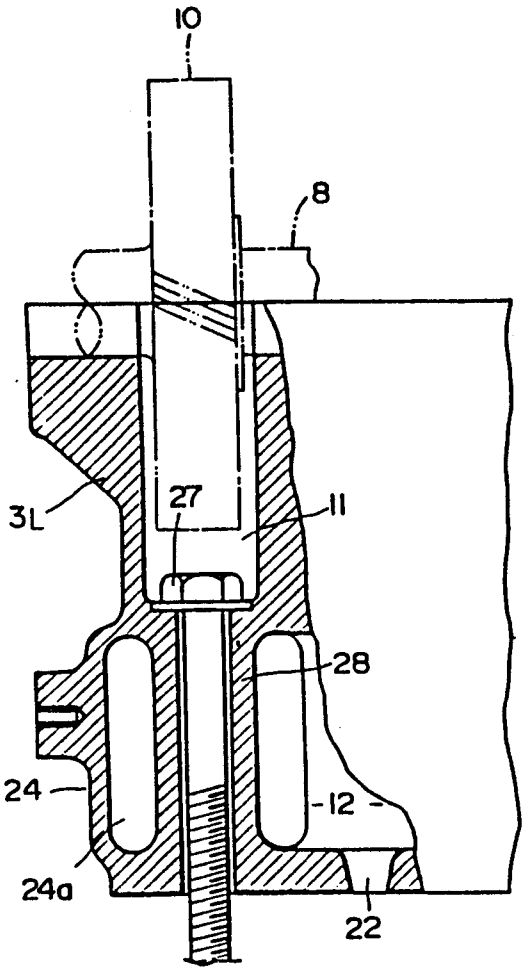
FIG. 4 is an enlarged cross-sectional view as seen along line IV—IV of FIG. 2.
Figure 3:
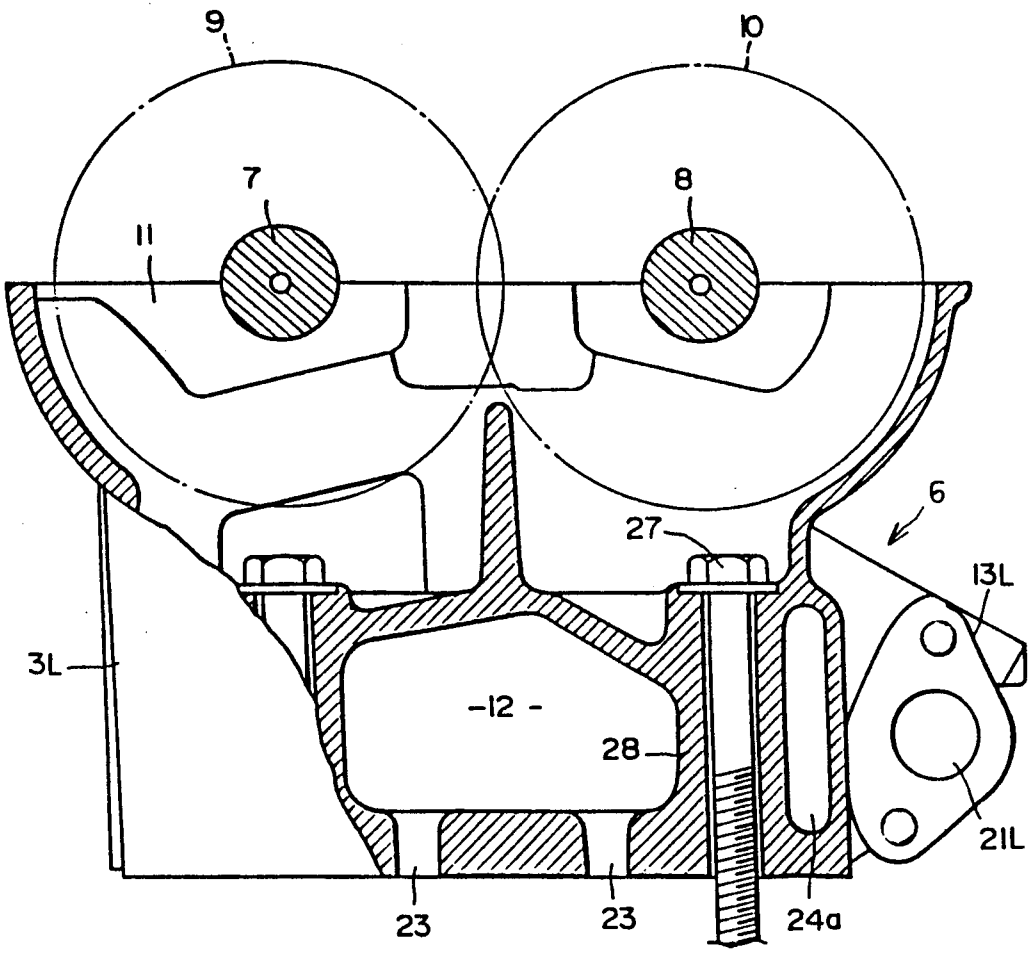
FIG. 3 is an enlarged cross-sectional view as seen along line III—III of FIG. 2.
Figure 5:
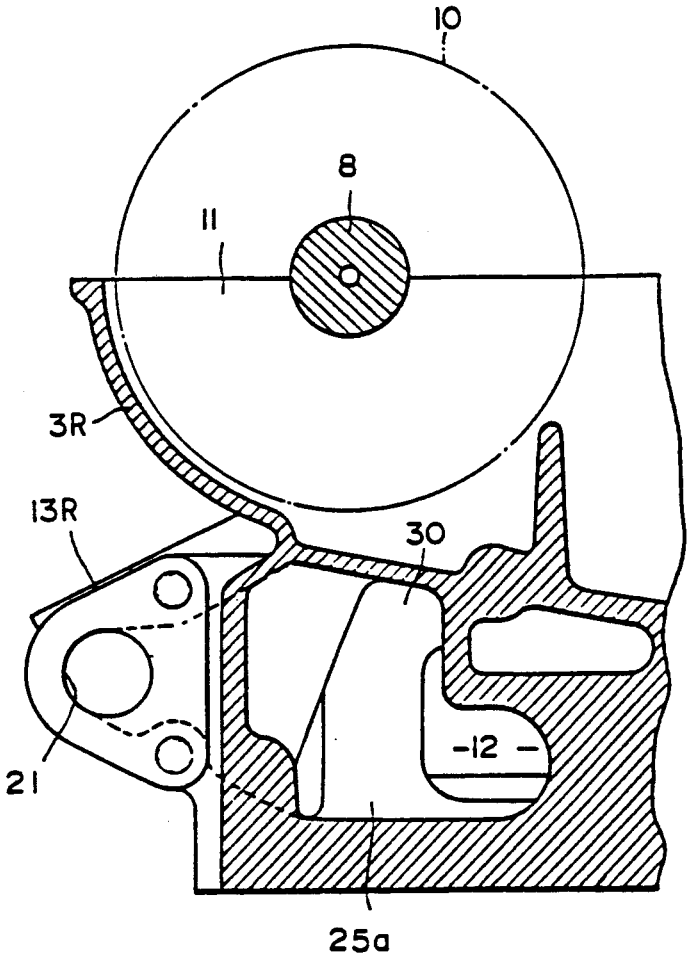
FIG. 5 is an enlarged cross-sectional view as seen along line V—V of FIG. 2.

As is shown in detail in FIGS. 3 and 4, in the left cylinder bank 4L, camshaft gears 9 and 10 are secured to first ends of the intake and exhaust camshafts 7 and 8, respectively, at the front end of the engine 1. The camshaft gears 9 and 10 mesh with each other so as to turn the intake and exhaust camshafts 7 and 8 in opposite directions. As is shown in FIG. 5, similarly, in the right cylinder bank 4R, camshaft gears 9 and 10 (only the exhaust camshaft 8 and gear 10 are shown in FIG. 5) are secured to first ends of the intake and exhaust camshafts 7 and 8, respectively, at the front end of the engine 1. The camshaft gears 9 and 10 mesh with each other so as to turn the intake and exhaust camshafts 7 and 8 in opposite directions. Either one of the intake and exhaust camshafts 7 and 8 in each bank 4L or 4R is operationally connected or coupled to the crankshaft by a belt (not shown), which transmits the engine output to drive the one of the intake and exhaust camshafts 7 and 8 and, thereby, to drive the intake and exhaust camshafts 7 and 8 in opposite directions through the in-mesh camshaft gears 9 and 10.

Each of the in-mesh camshaft gears 9 and 10 is accommodated in a gear chamber 11 formed in a front upper portion of the cylinder head 3L or 3R of the engine 1 in each cylinder bank 4L or 4R.

A water pump 26 is attached, as a component of a cooling apparatus, to the front end of the cylinder block 2 of the engine 1. Cooling water discharged from the water pump 26 is supplied to water jackets (not shown) formed in the cylinder block 2 for the left and right cylinder banks 4L and 4R to cool the cylinders 5. After cooling the cylinders, the cooling water is forced to flow into water jackets 12, formed in the left and right cylinder heads 3L and 3R, so as to cool combustion chambers of the cylinders 5. The cooling water in the left cylinder bank 4L is discharged from a first or left outlet port 13L into a left discharge passage 14L which will be described in detail later. Similarly, the cooling water in the right cylinder bank 4R is discharged from a second or right outlet port 13R into a right discharge passage 14R which will also be described in detail later. The cooling water discharged into the left and right discharge passages 14L and 14R flows together into a confluence passage 15, and is returned to the radiator 17 through a return passage 16. The radiator 17 cools the cooling water, which has been heated as a result of cooling the engine 1, and delivers the cooled water to the water pump 26, from an outlet 18, through a cooling water delivery passage with a built-in thermostatic valve (not shown).

The cooling apparatus described above has a bypass system which allows cooling water discharged into the left and right discharge passages 14L and 14R via the left and right outlet ports 13L and 13R, respectively, to bypass the radiator 17 in order to prevent over-cooling of the engine 1 when the temperature of cooling water is low. However, since this bypass system is not essential to the present invention, it is not further described here.

In the cooling apparatus described above, the left and right outlet ports 13L and 13R for the respective cylinder banks 4L and 4R ar formed in the front ends of the left and right cylinder heads 3L and 3R, respectively. Particularly, in the left cylinder bank 4L, which projects forward in the lengthwise direction of the crankshaft, with respect to the vehicle, relative to the right cylinder bank 4R, the left outlet port 13L, as is clear from FIG. 2, is communicated with the water jacket 12 surrounding the intake and exhaust ports 19 and 20 at the front side portion and the inner side portion of the water jacket 12, and projects towards the opposite, namely right, cylinder bank 4R from the water jacket 12 between the left and right cylinder banks 4L and 4R. In the right cylinder bank 4R, the right outlet port 13R is communicated with the water jacket 12 surrounding the intake and exhaust ports 19 and 20 only at the front side portion of the water jacket 12 and projects towards the opposite, namely left, cylinder bank 4L from the water jacket 12 between the left and right cylinder banks 4L and 4R.

The left and right outlet ports 13L and 13R are formed at their ends with discharge openings 21L and 21R, respectively, which are located at the same positions in the lengthwise direction of the crankshaft so as to open forward with respect to the engine 1. The left and right outlet ports are intercommunicated by the left and right discharge passages 14L and 14R. The left discharge passage 14L, which communicates with the left outlet port 13L, extends laterally and upward from its junction with the discharge opening 21L towards the top of the right cylinder bank 4R. The right discharge passage 14R, which communicates with the right outlet port 13R, extends upwards from its junction with the discharge opening 21R towards the top of the left cylinder bank 4L. In this way, the left and right discharge passages 14L and 14R are united together and connected to the confluence passage 15, which is configured so as to run in a direction in which the left discharge passage 14L extends, and then communicate with the return passage 16.

In each cylinder bank 4L or 4R, cooling water flows into the water jackets 12 of the cylinder head 3L or 3R, from the water jacket of the cylinder block 2, through communication openings 22 and 23 bored in the cylinder head, and is forwarded, in the water jackets 12, to the outlet port 13. It is to be understood that although portions of the water jacket 12, indicated by arrows a and b on both sides of the intake and exhaust ports 19 and 20 in FIG. 2, appear to be separated or divided, these portions a and b are actually in communication with each other above the intake and exhaust ports, so that the flow of cooling water towards the outlet port 13 is not shut down.

As is shown in FIGS. 2 and 4, in the left cylinder bank 4L, the left outlet port 13L is communicated with the front portion and the side portion of the water jacket 12 by a cavity 24*a*, formed in an expanded portion 24 so as to surround a boss 28 for a head bolt 27 by which the left cylinder head 3L is bolted to the cylinder block 2. Referring to FIG. 2, reference character 12*e* designates, generally, the end portions of each water jacket 12 of the cylinder banks, while reference character 12*s* designates, generally, the side portion of the left water jacket. The expanded portion 24 is formed so as to project outwardly from a front end corner of the left cylinder head 3L and into a space, which previously was left unused, below the gear chamber 11 of the left cylinder head 3L. Similarly, in the right cylinder bank 4R, the right outlet port 13R is communicated with the front portion of the water jacket 12 by a cavity 25*a*, formed in an expanded portion 25 so as to surround a boss 30 for a head bolt 29 by which the right cylinder head 3R is bolted to the cylinder block 2. The expanded portion 25 is formed so as to project outwardly from a front end corner of the right cylinder head 3R within a space, which previously was left unused, below the gear chamber 11 of the right cylinder head 3R.

According to the cooling water passage structure of this invention as described above, since the left and right cooling water outlet ports 13L and 13R of the left and right cylinder banks 4L and 4R are, respectively, located on the sides of the respective cylinder heads 3L and 3R, these cooling water outlet ports 13L and 13R do not project, in the lengthwise direction of the crankshaft, from the front ends of the respective cylinder heads 3L and 3R. Accordingly, piping forming the cooling water discharge passages 14L and 14R for the outlet ports 13L and 13R, respectively, occupies a space created at the front of the right cylinder bank 4R. This space is formed by the left cylinder bank 4L, which projects, or is offset, forward, in the lengthwise direction of the crankshaft, relative to the right cylinder bank 4R. That is, the cooling water passages of the present invention are laid out in previously unoccupied space, originally known as "dead space." This layout of the cooling water passages in the dead space provides a shortened overall length of the engine 1.

Furthermore, because it is typical for an intake manifold connected to the intake ports 19 to be installed in a V-space formed between the left and right banks 4L and 4R, space between the intake manifold and the V-space is effectively utilized in laying out the outlet ports 13L and 13R. This contributes to making the engine more compact.

In addition, because the discharge openings 21L and 21R of the left and right outlet ports 13L and 13R are in the same position in the lengthwise direction of the crankshaft, the piping configuration of the left and right discharge passages 14L and 14R connected to these outlet ports 13L and 13R, respectively, and the confluence passage 15, is simplified and, therefore, the passages are made compact.

In the left cylinder bank 4L, which projects in the lengthwise direction of the crankshaft and has the left outlet port 13L solely disposed in the side surface of the cylinder head 3L, it is possible that a smooth inflow of the cooling water in the water jacket 12L will be lost and the flow rate of cooling water will be reduced. Cooling efficiency, therefore, could be lost, and the system may fail to sufficiently cool the engine. However, as was described above, the expanded portion 24 is formed so as to utilize the space formed below the gear chamber 11 of the left cylinder head 3L, without any increase in the overall length of the engine, so that the cavity 24*a* formed in the expanded portion 24, which in turn constitutes a front portion of water jacket 12, is communicated sufficiently with the left output port 13L. Therefore, the left outlet port 13L communicates with both the front and side portions of the water jacket 12L, so as to allow cooling water to flow smoothly into the left outlet port 13L from the water jacket 12L and to maintain a high flow rate, thereby contributing to cooling the engine with high efficiency.

Because, in the right cylinder bank 4L, there is surplus space at the front portion of the right cylinder head 3R, due to the offset thereof rearward in the lengthwise direction of the crankshaft relative to the left cylinder head 3L, the outlet port 13R can be less steeply communicated with the front portion of the water jacket 12, so that a smooth in-flow of cooling water from the water jacket 12 into the outlet port 13R is obtained. By providing the expanded portion 25 below the gear chamber 11 and forming the cavity 25*a* in the expanded portion 25 so as to be in communication with the port 13R in the side of the cylinder head 3R, cooling water is allowed to flow smoothly into the right outlet port 13R from the water jacket 12 and to maintain a high flow rate.

In addition, the expanded portions 24 and 25 of the cylinder banks 4L and 4R provide a strong, rigid support structure, not only for the cam chambers 11 but also for the intake and exhaust camshafts.

The V-type engine 1, which is cooled with high cooling efficiency and yet is short in overall length and compact in structure, is useful in the case where the engine is to be installed transversely in an engine compartment with limited available space for engine.

As is apparent from the above description, because the V-type engine of the present invention is provided with outlet ports located in the side surfaces of the cylinder heads of the respective banks, respectively, the output ports do not extend forward in the lengthwise direction of the crankshaft beyond the ends of the cylinder heads. The piping forming cooling water passages for the outlet ports is provided within the dead space formed between the front ends of the left and right banks, offset in the lengthwise direction of the crankshaft relative to each other. Accordingly, the engine is not subjected to an increase in overall length, and the engine, including the cooling water passages, remains compact in size. Because of the same location, in the lengthwise direction of the crankshaft, of the outer port discharge openings, the arranged cooling water passages, connected to the outlet ports, are simplified in formation and are satisfactorily compact, so that it is possible to keep the engine short in overall length.

Furthermore, because the outlet port for the cylinder bank, which is offset in the lengthwise direction of the crankshaft relative to the other cylinder bank, is in communication with both the front portion and the side portion of the water jacket, even though the outlet ports are located in the side portion of the cylinder head, the flow rate of the cooling water, flowing from the water jacket into the outlet port, is kept high, so as to cause the cooling water to flow smoothly through the water jacket, thereby ensuring a high cooling efficiency.

It is to be noted that although the present invention has been described, in detail, with respect to a preferred embodiment thereof, various other embodiments and variants are possible which fall in the scope and spirit of the invention, and such other embodiments and variants are intended to be covered by the following claims.

What is claimed is:

1. A cooling passage structure for a V-type engine having first and second cylinder banks set at an angle to each other to define a V-shaped space therebetween, each cylinder bank including a common cylinder block, having rows of cylinders formed therein, said cooling passage structure comprising:

a cylinder head included in each cylinder bank, said cylinder head being mounted on said cylinder block and formed with a row of intake and exhaust ports, each cylinder head including a water jacket formed therein so as to surround the row of intake and exhaust ports, the row of intake and exhaust ports of said first cylinder bank being offset forward, in a lengthwise direction of said engine, relative to the row of intake and exhaust ports of said second cylinder bank;

one of the cylinder heads including a first port formed in an expanded portion thereof projecting from one side of said first cylinder bank into said V-shaped space, said first port communicating with an end portion of one of the water jackets adjacent to a front end of the row of intake and exhaust ports and with a side portion of the one water jacket adjacent to said end portion, for admitting a flow of cooling water;

the other of the cylinder heads including a second port projecting from one side of said second cylinder bank into said V-shaped space, said second port communicating with an end portion of the other of the water jackets adjacent to a front end of the row of intake and exhaust ports, for admitting a flow of cooling water;

said first and second ports having discharge openings opened in the same direction and at the same location in the lengthwise direction of the engine.

2. A cooling passage structure as recited in claim 1, and further comprising means for providing a confluence passage for permitting cooling water, passing through said first and second ports, to flow together.

3. A cooling passage structure as recited in claim 2, wherein at least part of said confluence passage is located in a space at least partially formed by said one side of said first cylinder bank and a front end of said second cylinder bank.

4. A cooling passage structure as recited in claim 1, wherein each cylinder head is provided with a gear chamber projecting laterally therefrom for receiving therein a gear train which operationally couples intake and exhaust camshafts, each of said ports being provided below said gear chamber.

5. A cooling passage structure as recited in claim 4, wherein said expanded portion is integrally provided on one side of said one of said cylinder heads, below said gear chamber, said first ports being formed in the expanded portion.

* * * * *